United States Patent [19]

Bradley et al.

[11] Patent Number: 4,556,447

[45] Date of Patent: Dec. 3, 1985

[54] ADHESIVE APPLICATORS

[76] Inventors: Albert J. Bradley, 3 Coach House, Saltford Ct., Saltford, Bristol; Barrie D. Lake, Sherbourne Cottage, Redlands La., Bishop Sutton, Bristol, both of England

[21] Appl. No.: 601,336

[22] Filed: Apr. 17, 1984

[30] Foreign Application Priority Data

Apr. 21, 1983 [GB] United Kingdom ..... 8310856

[51] Int. Cl.[4] ..... B65C 11/04

[52] U.S. Cl. ..... 156/578; 118/258; 118/693; 118/694

[58] Field of Search ..... 156/578; 118/258, 259, 118/262, 261, 693, 694

[56] References Cited

U.S. PATENT DOCUMENTS 2,205,443 6/1940 Soltan ..... 118/259

2,314,172 3/1943 Soltan ..... 118/259 X 2,390,498 12/1945 Capita ..... 118/259 X 3,361,112 1/1968 Talbot ..... 118/259 X

*Primary Examiner*—David Simmons

*Attorney, Agent, or Firm*—Young & Thompson

[57] ABSTRACT

A supply tank 11 from which adhesive will be dispensed by an applicator wheel 12 to the flap of a carton incorporates a valve assembly 16 connected through an inlet 20 to a pressurized supply of molten adhesive. The adhesive will enter pockets 19 in a rotating feed member 14 carried by a shaft 13 and mounted in a housing 15. If the level of adhesive in the supply tank 11 falls below the top of an outlet 21 from the housing 15 then any charge of adhesive within a pocket 19 passing the opening 21 will be dispensed into the supply tank 11 by gravitation. There is no direct connection between the pressurized supply to the inlet 20 and the outlet 21.

14 Claims, 6 Drawing Figures

ADHESIVE APPLICATORS

This invention is concerned with units for supplying adhesive for application, for example, to the flap of a carton in the course of construction. Normally such adhesive has to be fed to a supply tank under pressure and there are problems in ensuring that the supply tank does not overflow if an automatic feed is required.

It is an object of this invention to provide an adhesive supply unit incorporating a supply tank which may readily be charged continually with adhesive to a predetermined level from a remote source.

Accordingly, this invention provides an adhesive supply unit comprising a supply tank having an inlet for connection to an adhesive reservoir for the supply of adhesive under pressure, the inlet leading to a valve in the form of a rotating or reciprocating feed member within a housing and incorporating one or more pockets which will be aligned initially with the inlet to receive a charge of adhesive and subsequently with an outlet from the housing above the base of the interior of the supply tank so as to be able to deposit the charge of adhesive into the supply tank, the top of the outlet from the housing being situated below the lip of the interior of the supply tank.

The valve of the supply unit is such that it can be connected continuously to a pressurised supply of adhesive but it will not allow a greater amount of adhesive to build up within the supply tank than is defined by a predetermined level, namely the top of the outlet from the housing. If a pocket carrying a charge of adhesive is brought into communication with the outlet, but the level of adhesive is at or above the top of the outlet then that charge of adhesive cannot be discharged (under gravitational influence) and will be carried back to the inlet thus preventing a further charge from being supplied to that pocket through the pipe or hose.

In one arrangement the feed member may be carried for rotation on a drive shaft. In this instance the pockets may be cut into the shaft or an enlargement thereof defining the feed member. As an alternative the feed member could be a gear wheel meshing with an idler gear at the outlet from the housing. In another arrangement the feed member may be a reciprocating piston having pockets formed in its side wall. If the piston is of circular cross-section the pockets may advantageously be annular pockets which will register with radially displaced inlet and outlet openings.

The unit will preferably include an applicator wheel for dispensing the adhesive from the supply tank. It will then be possible for the drive member for rotating the applicator wheel to be linked to or form a part of the drive for the feed member.

It is particularly preferred that the supply tank should define a circular or part-circular interior centred on the rotational axis of the applicator wheel. This ensures that the rim of the applicator wheel, which will be heated by conduction from the adhesive with which it is in contact, will be at a fairly even temperature throughout. It is of further advantage to provide that the valve housing is also circular and is comparable in radius to the interior of the supply tank, for similar reasons. In most instances it is envisaged that the supply tank will incorporate a heater for maintaining the adhesive in a liquid state, and a circular housing, and other parts, ensures a fairly even temperature gradient in the radial direction of the unit.

Another preferred feature is that the applicator wheel should be coated with a polytetrafluorethylene material as this tends to reduce "stringing" of the adhesive between the applicator wheel and the carton or the like to which the adhesive is to be applied.

The invention may be performed in various ways and preferred embodiments thereof will now be described, with reference to the accompanying drawings, in which.

Figure 1:
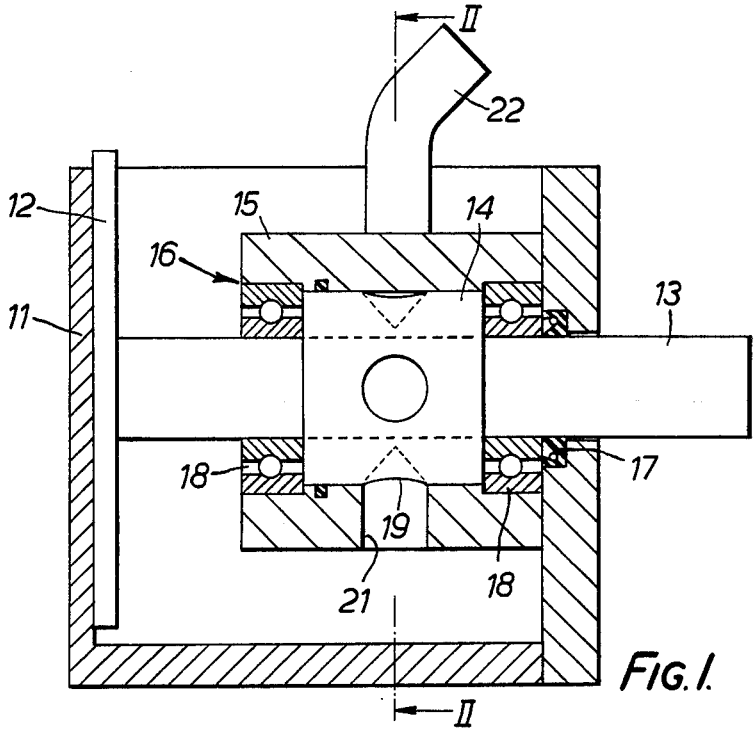
FIG. 1 is a cross-section through a supply tank incorporating a valve assembly of an adhesive applicator of this invention.
Figure 2:
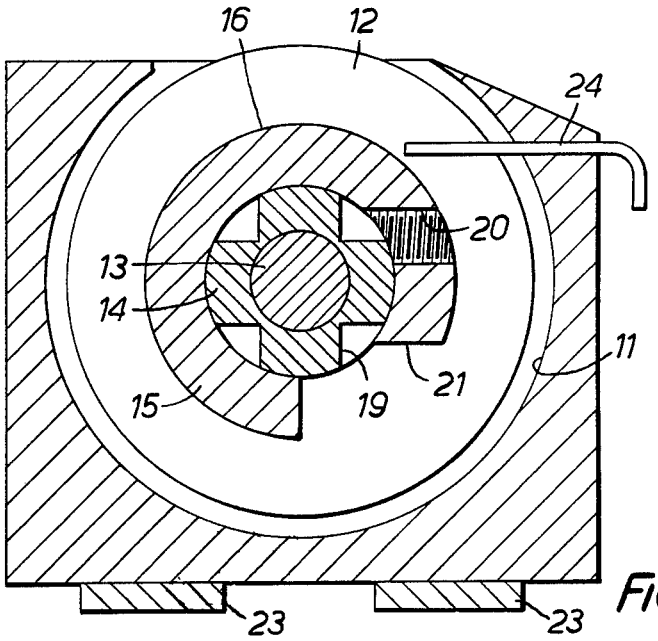
FIG. 2 is a cross-section through the supply tank generally on line II—II of FIG. 1.

A supply tank 11 for liquid adhesive is illustrated in FIGS. 1 and 2. This supply tank 11 may be connected to any convenient pressurised adhesive supply means from a reservoir. The supply tank 11 incorporates an applicator wheel 12 rotatably driven by a shaft 13. The exposed edge portion of the wheel 12 protruding above the top of the supply tank 11 can be brought into contact with a flap of a carton, for example, so as to apply adhesive to that flap.

The shaft 13 carries a feed member 14 situated within a housing 15 of a valve assembly 16. A seal 17 is provided at the inlet of the shaft 13 into the supply tank 2 and bearings 18 are defined between the shaft 13 and the housing 15. Any adhesive tending to leak through the inner bearing 18 will lubricate that bearing.

The feed member 14 incorporates a series of pockets 19 which, as the feed member 14 rotates with the shaft 13, are brought into alignment, in sequence, with an inlet 20 of the housing 15 and an opening 21 from the housing 15 into the supply tank 11. An inlet hose 22 (FIG. 1) is screwed into the inlet 20 and will be connected to a pressurised source of adhesive. Thus as an empty pocket 19 comes into alignment with the inlet 20 it will be filled with a charge of adhesive which will then be carried around to the outlet 21. If the overall level of adhesive within the supply tank 11 is lower than the top of the outlet 21 then the charge of adhesive within the pocket 19 will be discharged into the interior of the supply tank 11. By this means the level of adhesive within the supply tank 11 is maintained at the level defined by the top of the outlet 21. If the liquid level is at or above the top of the outlet 21, then a charge in a pocket 19 cannot be dispensed and will be carried round again to and past the inlet 20.

The supply tank 11 is heated by heaters 23 to maintain the adhesive therein in a molten state (at about 150° C.). It will be noted that the interior of the supply tank 11 is circular in cross-section so as to create a substantially even temperature gradient radially inwardly through the adhesive so that adhesive in contact with the rim of the applicator wheel 12 will be at a fairly even temperature throughout. The housing 15 (and associated parts) is generally also circular in cross-section and aligned on the same axis as the applicator wheel 12. The size of the housing 15 could be increased, if desired, so that it is closer to the curved wall of the interior of the supply tank 11 thus ensuring more immediate heat transfer to the housing 15 and feed member 14 from the heaters 23. The charges of adhesive carried in the pockets 19 will then be at a temperature at least approaching the melt temperature for the adhesive.

FIG. 2 of the drawings also illustrates a scraper blade 24 for removing excess adhesive from the rim of the applicator wheel 12 before the adhesive is applied to a carton flap or the like.

Figure 3:
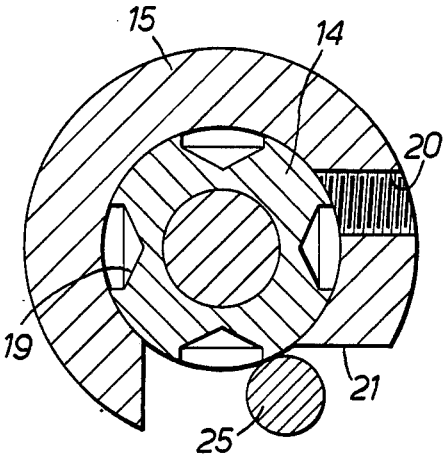
FIGS. 3 to 5 are cross-sections through three possible forms of valve assembly for the applicator.
Figure 4:
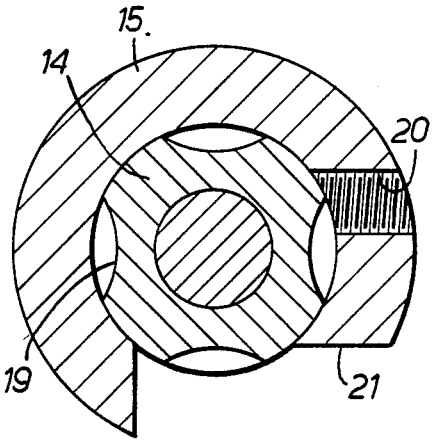
Figure 5:
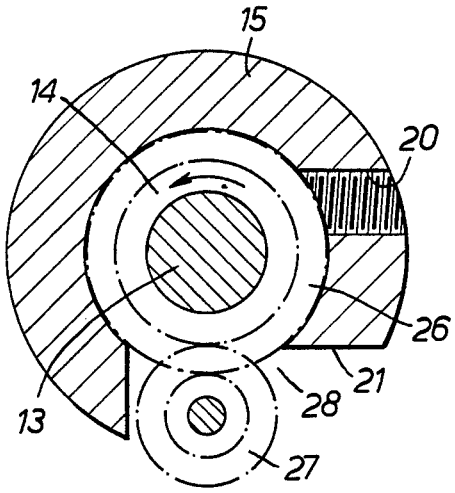

FIG. 3 illustrates a feed member 14 having drilled pockets 19 similar to those illustrated in FIG. 2. Also illustrated is a non-rotating rod 25 which may have a milled surface and which tends to pull adhesive from the feed pockets 19, as they pass by, by a surface tension draw-off effect. As shown in FIG. 4 the pockets 19 could be of milled form. Another possibility as illustrated in FIG. 5, is to form the feed member 14 as a gear having gear teeth 26 which take the place of the feed pockets 19 shown in the other embodiments. As the adhesive is carried round within the small pockets defined by the gear teeth 26 they are then drawn off by a smaller gear wheel 27 situated in the opening 21 so as to refill the supply tank 11 if the level therein has dropped below the top of the outlet 21. Otherwise the excess adhesive will be picked up again by the gear teeth 26 on the feed member 14 in the region 28 and will be carried round again to and past the inlet 20.

Figure 6:
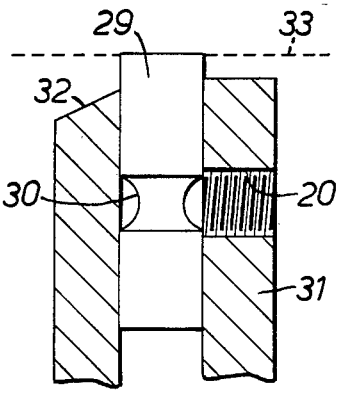
FIG. 6 illustrates another adhesive applicator of this invention.

The alternative form of device shown in FIG. 6 incorporates a reciprocating plunger 29, actuated, by a cam (not shown). The plunger incorporates an annular groove 30 which will alternately be aligned with the inlet 20 (connected to a heated hose carrying the liquid adhesive) and an outlet from the housing 31 incorporating the inlet 20 so that a charge of adhesive within the groove 30 will be dispensed into the supply tank down the sloping face 32 if the liquid level in the supply tank falls below that indicated by the dashed line 33.

We claim:

1. An adhesive supply unit comprising a supply tank having a top lip and an interior base, a valve positioned within the supply tank, the valve comprising a housing defining an inlet for connection to an adhesive reservoir, for the supply of adhesive under pressure, the valve also incorporating an outlet above the base of the interior of the supply tank, the top of the outlet from the housing being situated below the lip of the interior of the supply tank, and a feed member movable within the housing, the feed member defining at least one pocket in the form of a recess in the feed member which will be aligned initially only with the inlet to receive a charge of adhesive and subsequently will be aligned, upon movement of the feed member, only with the outlet from the housing so as to be able to deposit the charge of adhesive into the supply tank, if the level of adhesive has fallen below the level of the top of the outlet, the charge of adhesive otherwise being carried back in the pocket to the inlet upon further movement of the feed member.

2. An adhesive supply unit according to claim 1, wherein the feed member is carried for rotation within the housing on a drive shaft.

3. An adhesive supply unit according to claim 2, wherein the pockets are cut into the part of the drive shaft defining the feed member.

4. An adhesive supply unit according to claim 2, wherein a rod is provided in the outlet close to the surface of the feed member.

5. An adhesive supply unit according to claim 2, wherein the feed member is a gear wheel meshing with an idler gear at the outlet from the housing.

6. An adhesive supply unit according to claim 1, wherein the feed member is a reciprocating piston having at least one pocket formed in its side wall.

7. An adhesive supply unit according to claim 6, wherein the piston is of circular cross-section.

8. An adhesive supply unit according to claim 6, wherein the piston is of circular cross-section and each pocket is an annular pocket which will register with radially displaced inlet and outlet openings.

9. An adhesive supply unit according to claim 1, including an applicator wheel for dispensing the adhesive from the supply tank.

10. An adhesive supply unit according to claim 9, wherein a drive member for rotating the applicator wheel is part of the drive for the feed member.

11. An adhesive supply unit according to claim 9, wherein the supply tank defines a circular or part-circular interior centred on the rotational axis of the applicator wheel.

12. An adhesive supply unit according to claim 11, wherein the valve housing is also circular and has a radius approaching that of the interior of the supply tank.

13. An adhesive supply unit according to claim 9, wherein the applicator wheel is coated with a polytetrafluorethylene material.

14. An adhesive supply unit according to claim 1, wherein the supply tank incorporates a heater for maintaining the adhesive in a liquid state.

* * * * *